US006551236B1

(12) United States Patent
Liegois

(10) Patent No.: US 6,551,236 B1
(45) Date of Patent: Apr. 22, 2003

(54) ARTIFICIAL INSEMINATION DEVICE FOR LIVESTOCK SUCH AS, IN PARTICULAR, SOWS

(75) Inventor: Luc Liegois, Raimbeaucourt (FR)

(73) Assignee: Genes Diffusion Societe Anonyme, Douai (FR)

( * ) Notice: Subject to any disclaimer, the term of this patent is extended or adjusted under 35 U.S.C. 154(b) by 0 days.

(21) Appl. No.: 09/402,819

(22) PCT Filed: Apr. 23, 1998

(86) PCT No.: PCT/FR98/00817

§ 371 (c)(1),
(2), (4) Date: Oct. 8, 1999

(87) PCT Pub. No.: WO98/48731

PCT Pub. Date: Nov. 5, 1998

(30) Foreign Application Priority Data

Apr. 25, 1997 (FR) ..... 97 05425

(51) Int. Cl.[7] ..... A61D 19/02
(52) U.S. Cl. ..... 600/35

(58) Field of Search ..... 600/33, 35; 604/403; 222/527, 529, 541.2; 383/202, 906

(56) References Cited

U.S. PATENT DOCUMENTS

| | | | | | |
|---|---|---|---|---|---|
| 3,712,303 | A | * | 1/1973 | Merkt et al. | 600/35 |
| 3,811,423 | A | * | 5/1974 | Dickinson, III et al. | 600/35 |
| 5,536,243 | A | * | 7/1996 | Jeyendran | 600/35 |
| 5,674,178 | A | * | 10/1997 | Root | 600/35 |
| 5,899,848 | A | * | 5/1999 | Haubrich | 600/35 |

* cited by examiner

*Primary Examiner*—Max F. Hindenburg
*Assistant Examiner*—Joseph A. Cadugan
(74) *Attorney, Agent, or Firm*—Harrison & Egbert

(57) ABSTRACT

An artificial insemination device for breeding animals, such as sows, including a catheter suitable for being introduced into the genital system so as to enable sperm to be discharged therefrom and a reservoir of sperm connected to the catheter. The catheter has a conduit with an end piece at a distal end thereof. The conduit is suitable for lodging in the neck of the animal's uterus. A ring is provided so as to form a tight seal between the reservoir and the catheter.

8 Claims, 1 Drawing Sheet

ARTIFICIAL INSEMINATION DEVICE FOR LIVESTOCK SUCH AS, IN PARTICULAR, SOWS

TECHNICAL FIELD

The present invention relates to an artificial insemination device for breeding animals such as, sows.

However, although more especially developed for such applications, the invention can also be used for any other type of animal having a similar genitals system.

BACKGROUND ART

At the present time, to carry out artificial insemination of sows, use is made of flexible bottles or bags, containing diluted sperm, connected via a conduit to a catheter ending in a end piece that becomes lodged in the neck of the uterus.

Such devices thus enable the sperm to be introduced into the uterus of the animal from the flexible bottle or bag held outside.

However, for this purpose, the stockbreeder first has to carry out a preliminary step. The diluted sperm is, in fact, stored at a temperature below its temperature of use and the bottle has to be heated in order to restore to the sperm its fertilizing properties.

Once this first step has been carried out, a catheter is placed inside the animal and then connected, via a conduit, to the bottle, the sperm then flowing into the uterus and thus permitting fertilization.

Although such devices are satisfactory in terms of inseminating efficiency, their use does, however, pose problems. To carry out the step of heating the diluted sperm, the stockbreeder has to have at his disposal an external heat source and he has to wait for the temperature to rise before connecting up to the catheter.

Such operations are thus time consuming, and the stockbreeder cannot proceed quickly from one animal to the next, which is particularly inconvenient when large numbers of livestock are involved.

For reasons of efficiency, insemination of the animals has to be possible on the same day, the day of the oestrus.

The object of the present invention is to provide an artificial insemination device for breeding animals that overcomes the aforementioned drawbacks and is easier to use.

Another object of the present invention is to provide an artificial insemination device for breeding animals that enables faster working rates to be obtained.

Another object of the present invention is to provide an artificial insemination device for breeding animals that enables the stockbreeder to reduce to a minimum the time spent with the animal.

Further objects and advantages of the present invention will emerge in the course of the following description, which is given only by way of illustration and is not intended to limit same.

SUMMARY OF THE INVENTION

The invention relates to an artificial insemination device for breeding animals, such as, sows, including:

- a catheter, suitable for being introduced into the genital system of the animal to enable the sperm to be discharged;
- a reservoir of sperm, suitable for being connected to the catheter and for also being introduced into the animal's genital system.

BRIEF DESCRIPTION OF THE DRAWINGS

The invention will be more readily understood from a study of the following description, accompanied by the annexed drawings, which form an integral part thereof, and wherein.

DETAILED DESCRIPTION OF THE INVENTION

Figure 1:
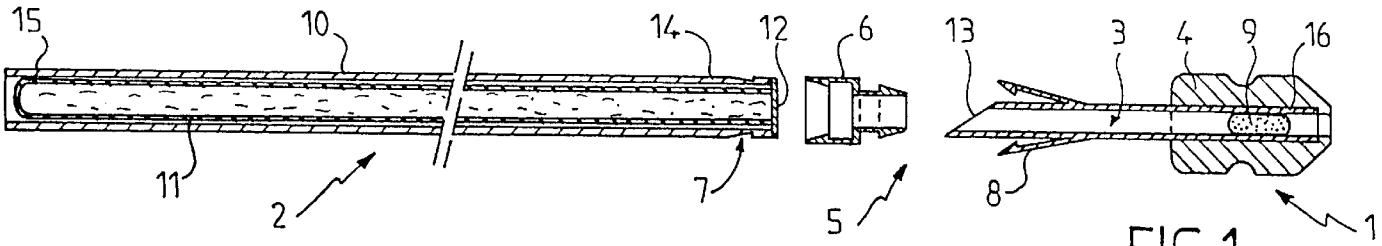
FIG. 1 is an exploded, in a longitudinal cross-sectional plane, of an exemplary embodiment of the artificial insemination device according to the invention.
Figure 2:
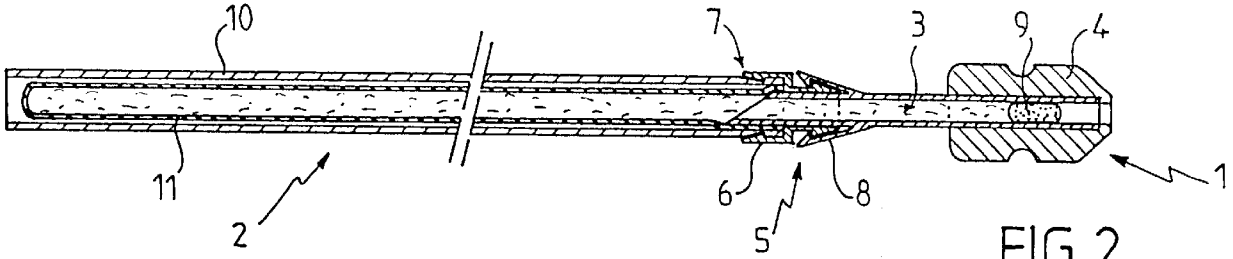
FIG. 2 illustrates the exemplary embodiment of the artificial insemination device, shown in preceding FIG. 1, in its assembled form.

As shown in FIGS. 1 and 2, the artificial insemination device according to the invention includes, on one hand, a catheter, 1, suitable for being introduced into the genital system of the animal to enable sperm to be discharged. Furthermore, it includes a reservoir, 2, of sperm suitable for being connected to the catheter 1 and for also being introduced into the animal's genital system.

As to the sperm, this is, for example, diluted sperm, that is to say a mixture containing spermatozoons, seminal liquid and a diluent.

Because of such a device, the stockbreeder's work is simplified. As the reservoir 2 is, in fact, introduced inside the animal, the sperm is warmed up by the latter's own warmth.

The stockbreeder thus no longer has to carry out the external heating operation, with its attendant risks, nor does he have to wait during artificial insemination, and another animal can thus be inseminated without delay. In addition, there is no longer any need for complicated, inconvenient external heating apparatus.

The said catheter 1 is constituted, at least by a conduit, 3, having at its distal end, 16, an end piece, 4, suitable for lodging, for instance, in the neck of the animal's uterus.

The catheter 1 thus enables sperm to be discharged into the uterus, in the area of the neck.

Figure 3:
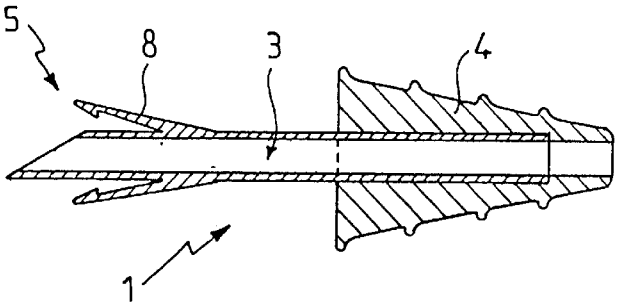
FIG. 3 is a cross-sectional view with the same orientation as before, showing another exemplary embodiment of one of the members of the artificial insemination device according to the invention.

To contribute to tightness in the uterine environment, the end piece 4 is designed, to be compressible and/or extensible. In addition, it can, for instance, be of a round shape or, as illustrated in FIG. 3, of a spiral or other shape.

So as to enable the sperm to enter the uterus, the end piece 4 is, tubular and/or fitted onto the conduit 3.

According to a first form of embodiment, the catheter 1 and the reservoir 2 are made in one piece. However, according to another form of embodiment, corresponding to that illustrated, it can prove an advantage to provide a catheter 1 and a reservoir 2 that are separate from one another.

For this purpose, the said catheter 1 further includes, if applicable, in the area of its proximal end, 13, means 5 for attachment to reservoir 2.

The attachment means 5 are constituted, by a ring, 6, suitable for forming a tight seal between the reservoir 2 and the catheter 1.

The ring 6 is formed, of an elastically deformable material permitting snap fitting onto the reservoir 2. To facilitate attachment, the latter is, moreover, provided, if applicable, with a groove, 7.

According to the form of embodiment illustrated, the ring 6 is also suitable, for snap fitting onto the catheter 1. For this purpose, the latter has, a skirt, 8, in the area of the proximal end of its conduit 3, suitable for mating with the matching shape of ring 6.

However, according to other forms of embodiment, it is also possible to contemplate providing a ring 6 formed directly on the conduit 3.

The catheter 1 further has, a plug, 9, constituted by a paste that is capable of gelling at a temperature slightly below that of the animal's genital system.

The sperm cannot, therefore, flow before reaching the desired temperature. Before this happens, it is, in fact, retained by the plug 9, which remains solid, and which liquefies to allow through the sperm only when the temperature of the latter approaches the desired temperature.

It will thus be appreciated that the use of such a plug 9 further facilitates the work of the stockbreeder, who no longer has to supervise the temperature rise of the sperm since the latter can neither exceed the desired temperature, the source of heat being provided by the animal itself, nor flow as long as its temperature remains too low, since the plug 9 will not yet have dissolved.

In addition, the stockbreeder does not have to intervene to trigger the discharge of the sperm since, here again, it is the actual warmth of the animal that acts to melt the plug.

The temperature at which the plug 9 liquefies is chosen, by way of example, to be in the region of 30° C., the paste of which it is made being in a gelled state below this temperature, and in a fluid state above it.

This being, the said reservoir 2 is, formed by a tube 10 suitable for receiving a bag, 11, containing the sperm.

The tube 10 is suitable for being placed, in the area of the animal's vagina and is, of a length substantially identical with the length of this organ.

The tube 10 is, rigid and/or semi-rigid, whereas the bag 11 is, flexible.

As too high a concentration of spermatozoons has a toxic effect upon the latter, the sperm must be prevented from settling in a small space.

Tube 10 thus has, at least one flat face, capable of being orientated downwards. For this purpose, the tube 10 is provided, with a polygonal, rectangular and/or square cross-section.

Furthermore, the tube 10 has, at its distal end, a plug, 12, suitable for being pierced by the catheter 1. In this connection, to facilitate such an operation, the conduit 3 will be provided, if applicable, with a bevelled proximal end 13.

As illustrated, the plug 12 of reservoir 2 also closes, the bag 11.

The sperm is transferred to the uterus by gravity feed, for example. The device according to the invention can also further include, if applicable, means, not shown, for facilitating the flow of the sperm from the reservoir 2 towards the catheter 1.

The means will take the form, of a coating of elastic material, provided on the walls of the tube 10, and/or of a piston, provided at the proximal end, 15, of the tube 10.

As is clear from the foregoing description, the exemplary form of embodiment of the device illustrated can be used as follows. First of all, the stockbreeder assembles the catheter 1 and the reservoir 2, then he introduces the whole into the animal's genital system, proceeding so as to lodge end piece 4 in the neck of its uterus.

At this point, the stockbreeder's role is over. As a result of the animal's own warmth, the sperm is heated and plug 9 liquefies to enable the sperm to flow automatically one the desired temperature has been reached.

All that it remains for the stockbreeder to do is to withdraw the device, once the insemination time has elapsed.

Other forms of embodiment within the grasp of a man of the art could, of course, have been contemplated without thereby departing from the scope of the invention.

What is claimed is:

1. An artificial insemination device for breeding an animal comprising:

a discharging means for discharging sperm into a genital system of the animal, said discharging means comprising a catheter having an exterior size suitable for being introduced into the genital system, said catheter having an interior conduit with a gelling means therein plugging said interior conduit, said gelling means formed of a paste for gelling at a temperature slightly below a temperature of the genital system;

a sperm warming means connected to one end of said catheter, said sperm warming means comprising a reservoir; and a quantity of sperm contained within said reservoir, said sperm warming means for warming said sperm in said reservoir by heat transfer from a body temperature of the animal, said gelling means for opening said conduit when the temperature of the genital system gels said paste such that at least some sperm of said quantity of sperm flows from said reservoir through said interior conduit of said catheter and outwardly of said catheter.

2. The device of claim 1, said discharging means further comprising a lodging means at an end thereof opposite said reservoir, said lodging means for lodging in a neck of a uterus of the animal.

3. The device of claim 2, said discharging means further comprising an attaching means at an end opposite said lodging means, said attaching means for attaching said catheter to said sperm warming means.

4. The device of claim 2, said attaching means comprising a ring forming a seal between said reservoir and said catheter.

5. The device of claim 1, said reservoir comprising a tube and a bag containing said quantity of sperm, and tube receiving said bag therein.

6. The device of claim 5, said tube having a polygonal cross-section.

7. The device of claim 5, said tube having a plug at a distal end thereof, said plug being pierceable by said discharging means.

8. The device of claim 5, said tube having a coating of elastic material on an interior wall thereof.

* * * * *